United States Patent [19]

Dudley

[11] Patent Number: 4,557,480

[45] Date of Patent: Dec. 10, 1985

[54] PORTABLE EXERCISE DEVICE

[75] Inventor: Edmond R. Dudley, Saratoga, Calif.

[73] Assignee: In-Door Gym, Los Gatos, Calif.

[21] Appl. No.: 541,523

[22] Filed: Oct. 13, 1983

[51] Int. Cl.[4] ..... A63B 21/00

[52] U.S. Cl. ..... 272/133; 272/131; 272/900; 272/136

[58] Field of Search ..... 272/900, 133, 131, 136, 272/143, 140; 248/223.4, 224.1

[56] References Cited

U.S. PATENT DOCUMENTS

| | | | |
|---|---|---|---|
| 3,596,907 | 8/1971 | Brighton | 272/131 |
| 3,807,675 | 4/1974 | Secherson et al. | 248/223.4 X |
| 4,114,875 | 9/1978 | Deluty | 272/133 |
| 4,253,663 | 3/1981 | Hughes | 272/133 X |
| 4,310,155 | 1/1982 | White | 272/136 |

*Primary Examiner*—Richard J. Apley
*Assistant Examiner*—Robert W. Bahr
*Attorney, Agent, or Firm*—Thomas E. Schatzel

[57] ABSTRACT

A portable resistive-type exercise device adapted for both arm and leg exercises. The device includes a housing containing a reel and a length of cord. Within the housing are adjustable friction blocks for applying tension to the cord whereby resistance is exerted against a force withdrawing the cord from the housing. A handle or strap is provided to transmit the force to both the arms and legs. A bracket is supplied which allow for permanent wall mounting or temporary mounting about a door frame.

3 Claims, 7 Drawing Figures

PORTABLE EXERCISE DEVICE

BACKGROUND OF THE INVENTION

1. Field of the Invention

This invention relates to a portable, resistive-type exercise device and more particularly to a portable arm and leg exerciser which utilizes frictional forces to provide resistance, and which may be easily mounted upon a rigid surface such as a wall or within a doorway.

2. Description of the Prior Art

In recent years, there has been a considerable increase in the number of individuals seeking physical exercise. While a wide variety of exercise routines are currently available, many individuals prefer those exercises that can be done in the home and with a minimum of equipment. Exercises to strengthen the arms and legs, typically involve either heavy weights, or bulky spring resistance means. Exercises employing weights as a means of resistance often must be used in conjunction with supportive apparatus, particularly where leg strengthening exercises are to be performed.

Accordingly, there is a need for a portable resistive-type exercise device which can provide sufficient resistance for a variety of exercises, and yet which is lightweight, simple and may be used in and under a variety of conditions.

SUMMARY OF THE INVENTION

It is an object of the present invention to provide a resistive exercise device which does not require large, bulky or heavy apparatus.

It is a further object of the present invention to provide an exercise apparatus which may be employed to exercise both arms and legs.

It is a further object of the present invention to provide a portable exercise device which may be temporarily mounted about a doorframe or which may be permanently or removably mounted to a wall.

It is yet another object of the present invention to provide a resistive-type exercise device which may be easily adjusted to provide varying amounts of resistance.

It is yet another object of the present invention to provide a resistive-type exercise device which is simple to use and economical to manufacture.

A preferred embodiment of the portable exercise device of the present invention includes a spring-loaded reel, mounted within a rectangular housing. Wound around the reel is a length of cord which passes from the reel around a guide post, through a pair of wedges containing a centrally located groove, and out through a hollow adjustment bolt projecting through an aperture within the housing. Attached to the cord outside of the housing is a snap swivel, to which may be attached either a hand bar for arm exercises, or a strap which may be fitted around a leg. At the rear of the housing is a slot for mating with a T-shaped mounting bracket. A first bracket is provided for permanent mounting on a stationary medium, e.g. a wall or closed door, and a second bracket is provided for temporarily mounting the apparatus about a door frame.

An advantage of the present invention is that it provides for a portable resistive-type exercise device which may be readily mounted within a door frame.

It is a further advantage of the present invention that it provides a portable exercise device which may be readily set up for use and removed after use.

It is a further advantage of the present invention that it provides a portable resistive-type exercise device which can be used for a variety of exercises.

It is a further advantage of the present invention that it provides a portable exercise device which is very compact and light in weight, thus it is easily carried while travelling.

These and other objects and advantages of the present invention will no doubt become obvious to those of ordinary skill in the art after having read the following detailed description of the preferred embodiment which is illustrated in the various drawing figures.

IN THE DRAWINGS

DETAILED DESCRIPTION OF THE PREFERRED EMBODIMENT

Figure 2:
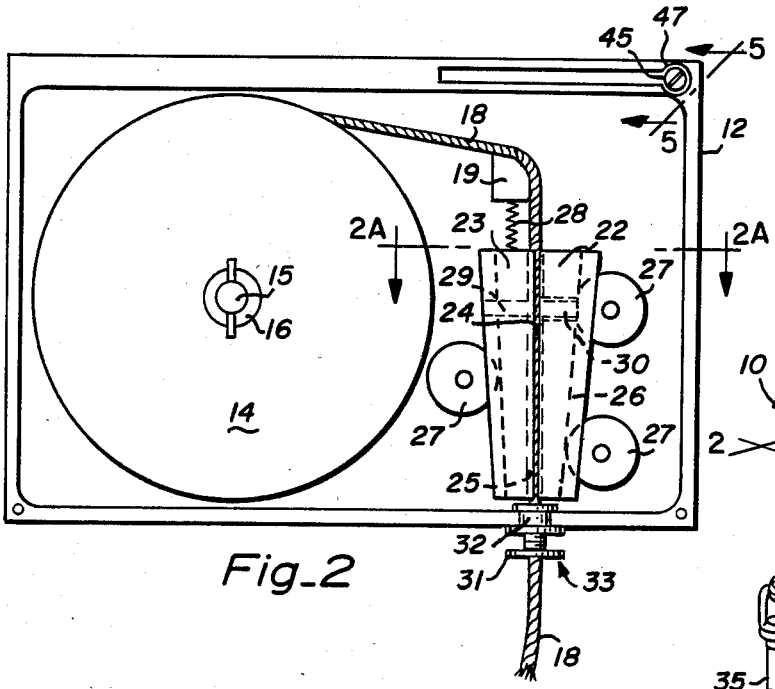
FIG. 2 is cut-away view taken along line 2—2 of FIG. 1, and illustrating the internal mechanism including the wedge tensioner means.
Figure 1:
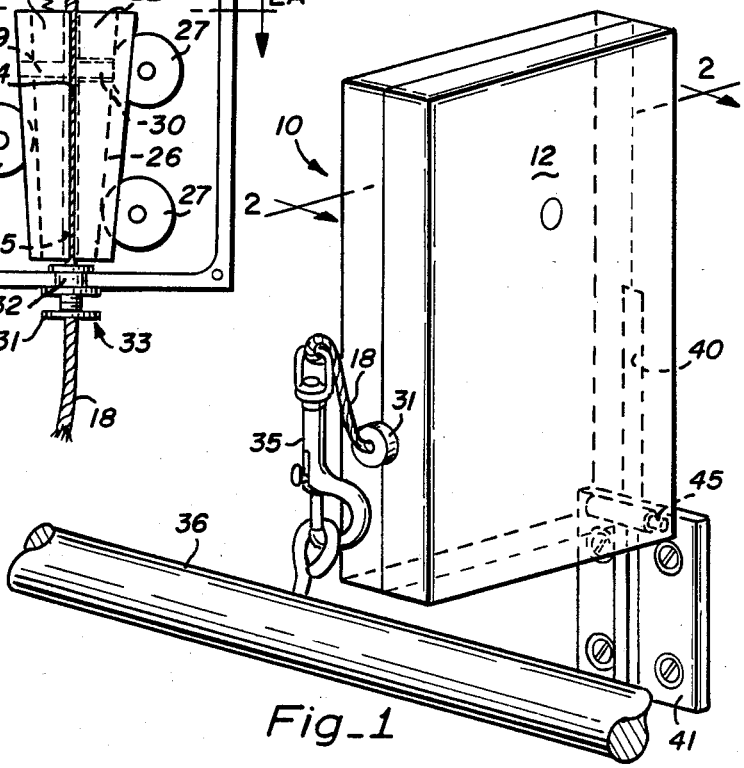
FIG. 1 is a perspective view of the portable resistive-type exercise device of the present invention.
Figure 3:
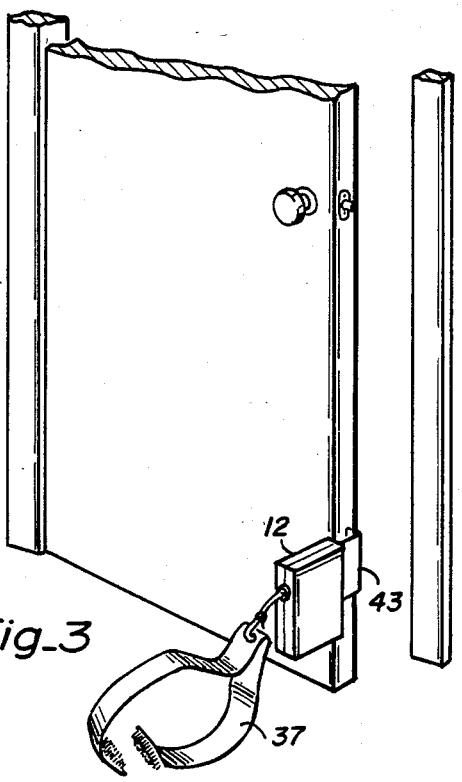
FIG. 3 is perspective view showing the present invention installed within a doorway and adapted for leg exercises.
Figure 2A:
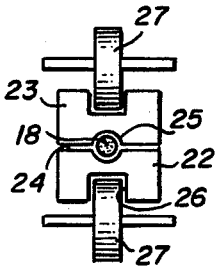
FIG. 2A is an end view of the tensioning wedges taken along line 2A—2A of FIG. 2.
Figure 4:
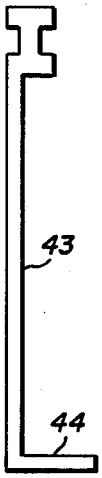
FIG. 4 is a side elevational view of the temporary bracket designed for supporting the present invention about a door frame.

FIG. 1 illustrates a portable, resistive-type exercise device of the present invention and referred to by the general reference character 10. The device 10 includes a housing 12, which is rectangular in shape and is approximately six inches long by four inches wide and one inch deep. The housing 12 may be constructed of any durable rigid material such as metal or high-impact plastic, and in the preferred embodiment 10 is constructed of aluminum. As illustrated in FIG. 2, within the housing 12 is secured a reel 14. Reel 14 is mounted on a central axle 15, which is spring-loaded to bias the reel 14 in favor of a counter-clockwise or "take-up" rotational direction. Isolating reel 14 from the housing 12 are a pair of bearings 16 intermediate the reel and housing. Wound around reel 14 is a cord 18. Cord 18 is a braided nylon cord, but could also be a woven cord with a central axial filament, and is about eight feet long. From the reel 14, cord 18 passes around a guide 19 and between a pair of wedges 22 and 23. Wedges 22 and 23 each have flat opposing faces 24 containing a central longitudinal groove 25, through which cord 18 passes. On the opposite face of each of wedges 22 and 23 is a slot 26. FIG. 2A illustrates an end view of the two wedges 22 and 23. The wedges 22 and 23 are slidably guided by and rollably engaged with a plurality of rollers 27 about slots 26. The amount of travel provided by wedges 22 and 23 is slight, on the order of one-half of an inch, but this is sufficient to compress the cord 18 about the central grooves 25 to provide resistance for the exercise device. To ensure that the wedges 22 and 23 will enter into frictional engagement with the cord 18, a drag spring 28 is provided to urge them into such engagement. Spring 28 is secured to guidepost 19 and to wedge 23 as shown in FIG. 2, and provides a small amount of tension to urge wedge 23 into a compressional engagement with wedge 22 about the cord 18. The wedges 22 and 23 are urged to move in unison by means of a pin 29 connecting the two. Pin 29 is rigidly attached to wedge 23 and slidably engaged with wedge 22 about an aperture 30 located therein. Pin 29 and aperture 30 are both perpendicular to and laterally offset from central longitudinal groove 25 of each wedge 22 and 23. On leaving the wedges 22 and 23, the cord passes through a hollow adjustment bolt 31 which is threaded through an adjustment bushing 32 mounted about an aperture 33 in the housing 12. Adjustment bolt 31 acts as a stop for the wedges 22 and 23 to halt their forward motion and thus regulate their frictional engagement with the cord 18. The further bolt 31 is screwed into bushing 32, the more restricted is the travel of wedges 22 and 23 and thus the resistive force is lessened. As bolt 31 is unscrewed the wedges 22 and 23 may travel further, increasing their frictional engagement with the cord 18 thereby increasing resistance. Outside of the housing 12, the cord 18 is attached to a snap swivel 35 as shown in FIG. 1. Snap swivel 35 is adapted for engaging an eyebolt of an exercise bar 36, or for engaging an eyelet of a leg exercise strap 37. Exercise bar 36 is a smooth bar, approximately sixteen inches in length and one inch in diameter and constructed of any durable, rigid material, such as metal, wood or plastic. Leg strap 37 may be of any flexible material and in the preferred embodiment is constructed of sheepskin for comfort and is secured around the leg by means of a fastening tape for example, that sold under the trademark Velcro. The leg strap 37 is attached to the snap swivel 35 by means of an eyelet inserted through a fold in the middle of the strap.

At the rear of housing 12 is a mounting slot 40, approximately three inches in length and opposite the aperture 33. Adapted to slidably fit within mounting slot 40 is permanent mounting bracket 41. Mounting bracket 41 may be constructed, like housing 12 of practically any strong, rigid material and in the preferred embodiment is constructed of aluminum. Mounting bracket 41 has a raised T-portion which slidably engages mounting slot 40 of housing 12. Bracket 41 is permanently mounted on a rigid surface, e.g. a wall by means of screws 42 located on its face. Also provided for mounting the housing 12 is temporary mounting bracket 43. Temporary bracket 43 is constructed of a high impact plastic as it requires a slight degree of flexibility for mounting about a door frame. Like permanent bracket 41, temporary bracket 43 contains at one end a T for engaging mounting slot 40 of the housing 12. At the other end of bracket 43 is a flange 44 for engaging a door. Temporary bracket 43 is of a width slightly greater than the width of a door, such that the flange 44 may be hooked about the inner or outer face of a door and the door then shut about the bracket 43. This secures the bracket 43 to the door frame and the housing 12 may then be inserted thereon, providing a temporary yet secure attachment for the housing 12.

Figure 5:
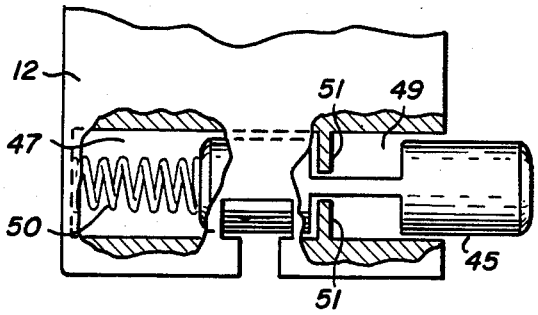
FIG. 5 is a cut-away view taken along line 5—5 of FIG. 2, and illustrating the locking pin mechanism.

To lock the housing 12 onto the bracket 41 or 43 a cylindrical locking pin 45 is provided as illustrated in FIG. 5. Pin 45 slidably fits into an aperture 47 which is perpendicular to the slot 40 and near the lower corner of the housing 12 and slot 40. Pin 45 is of a large enough diameter to block the slot 40 and thus to prevent the housing 12 from sliding off of bracket 41 or 43. Pin 45 includes a central ring-shaped cutout 49 which is sufficiently wide and deep to clear the slot 40. A spring 50 biases the pin 45 such that the slot 40 is normally blocked by one end of the pin 45, and the other end extends outside the housing 12. To insert or remove the housing 12 about a bracket 41 or 43, the pin 45 is pressed in until the cut-out 49 lines up with the slot 40. The slot 40 may now be inserted over the bracket 41 or 43. When the pin 45 is released the spring 50 urges the pin back into the locked position thereby securing the housing 12 about the bracket 41 or 43. A stop 51 within the housing 12 extends into the aperture 47 and to the outside of the slot 40. Stop 51 prevents the pin 45 from being urged completely out of the aperture 47.

The apparatus 10 is utilized by engaging mounting slot 40 with either temporary bracket 43 or permanent bracket 40. If temporary bracket 43 is being employed, it may be positioned at the height desired for the particular exercise. Either the bar 36, or the leg strap 37 is then attached to the snap swivel 35. The individual then grasps the bar 36, or inserts her leg through the leg strap 37, and exerts force outward on the bar or leg strap. As force is exerted, the cord 18 is released from the reel 14 and urges wedges 22 and 23 to compress against the cord 18 about the grooves 25. This compressing action of wedges 22 and 23 is the means by which the exercise resistive force is provided. By adjusting bolt 31, wedge travel, and corresponding resistance on the cord may be selected for the desired exercise.

In this manner a variety of exercises, working both the arms and legs may be performed in a short time. After use the apparatus is merely disengaged from the mounting bracket and stored.

Figure 6:
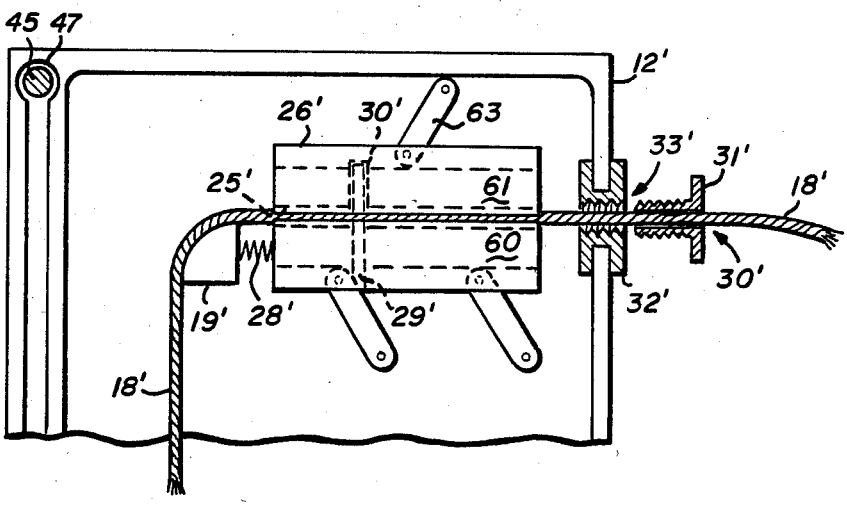
FIG. 6 is a cut-away view showing the alternative embodiment of the present invention.

An alternative embodiment of the tensioning means of the present invention is illustrated in FIG. 6. A cord 18' passes around a guide 19' and, between a pair of friction blocks 60 and 61. Blocks 60 and 61 are generally rectangular in shape with a central longitudinal groove 25' on one face and a flat longitudinal slot 26' on the opposite face. Pivot arms 63 are pivotably secured within the grooves 26' and to the housing 12'. A drag spring 28' is attached to guide 19' and to block 60 to ensure frictional engagement of the blocks 60 and 61 about the cord 18'. Joining the blocks 60 and 61 is a pin 29' which is rigidly connected to block 60 and slidably connected to block 61 about an aperture 30' in block 61. From between the blocks 60 and 61 the cord 18' passes through a hollow adjustment bolt 31' which is screwed into a threaded bushing 32' in an aperture 33' of the housing 12'. Pivot arms 63 are angled slightly, on the order of two to ten degrees, in the direction of the aperture 33'. This angle of the pivot arms causes the friction blocks 60 and 61 to describe an arc as they are urged forward by the cord 18'. At the apex of the arc, the blocks 60 and 61 are fully compressed about the cord 18'. At increasing angles of the pivot arms 63, the blocks 60 and 61 become increasingly separated. Control over travel of the blocks is accomplished by means of the adjustment bolt 31' just as in the preferred embodiment. The blocks 60 and 61 serve the same function as the wedges 22 and 23 of the preferred embodiment. Thus, friction by the cord 18' causes the blocks 60 and 61 to be urged forward, compressing the cord 18' and thereby providing resistance. The amount of travel of the blocks 60 and 61 is adjusted by adjustment bolt 31' so that the desired degree of resistance can be obtained.

Although the present invention has been described in terms of the presently preferred embodiment, it is to be understood that such disclosure is not to be interpreted as limiting. Various alterations and modifications will no doubt become apparent to those skilled in art after having read the above disclosure. Accordingly, it is intended that the appended claims be interpreted as covering all alterations and modifications as fall within the true spirit and scope of the invention.

I claim:

1. A portable resistive type exercise device comprising;

a hollow rectangular housing having a circular aperture formed therein to permit passage therethrough of a cord;

a spring loaded reel mounted within the housing;

a length of cord having a circular cross-section, and including a first terminal end attached to the reel, a second terminal end extending through said aperture, and an intermediate portion wound around the reel;

a first and second trapezoidal-shaped friction block slidably mounted within the housing to have a longitudinal direction of motion, each block having a first flat face containing a central longitudinal groove for receiving the cord and an opposing second flat face with a central longitudinal slot for receiving a roller, said first flat faces and said second flat faces describing intersecting planes, the friction blocks being mounted such that said central longitudinal grooves are parallel and made to describe a circular aperture through which the cord may pass in frictional contact with the blocks, the blocks being aligned such that a widest portion of the blocks is distal to said aperture and a narrowest portion of the blocks is proximal to said aperture, the blocks being slidably interconnected by a pin extending from the first block and slidably mating with an aperture formed in the second block, the first block further including a biasing means formed thereto to initiate said frictional contact between the blocks and the cord;

a plurality of rollers rotatably secured to the housing and slidably engaged with said longitudinal slots of the first and second blocks, the rollers being positioned to urge the blocks into compressional contact with the cord as the cord is drawn out through said aperture and as the blocks are urged by said cord toward said aperture;

guide means for directing the cord from the reel through said central longitudinal groove of the friction blocks;

a tension adjusting means for controlling the amount of travel of the first and second friction blocks, the tension adjusting means comprising a hollow bolt threaded through said aperture of the housing whereby the cord may pass therethrough, said bolt abutting the friction blocks about said longitudinal direction of motion to restrict said longitudinal motion and thereby the amount of compression exerted on the cord whereby the blocks exert a constant and fixed amount of tension on the cord at any given setting of the tension adjusting means, the blocks including sufficient contact area to provide resistance to the outward motion of the cord;

mounting means for mounting the housing to a fixed object; and exercise interface means to allow a user to couple various muscle groups to the cord whereby said muscle groups may be exercised.

2. The portable exercise device of claim 1 wherein said mounting means includes a slot located at the rear of the housing and opposite said cord aperture, said slot having a T-shaped cross section;

a bracket means having a T-shaped cross section adapted for mating with said T-shaped cross section of said slot, said bracket means being adapted for attachment to a stationary medium; and a pin, slidably mounted within said housing and extending transversely across said slot and having a segment protruding from said housing, said pin further including a cut-out positioned intermediate the slot and the protruding segment such that when said cut-out is aligned with said slot said bracket may be inserted therein, and when said cut-out is not aligned with said slot, said bracket may not be inserted, said pin further including means for biasing said pin such that said slot is normally blocked by said pin.

3. The portable exercise device of claim 2 wherein said bracket means includes a rigid bracket adapted for permanent mounting about a rigid surface, and further includes a temporary bracket for mounting between a door and door frame, said temporary bracket including a length of slightly flexible material, wider than a door and having a flange for engaging a door about its face, and sufficiently thin to allow a door to be closed thereon.

* * * * *